US012799398B2

(12) United States Patent
Uppili et al.

(10) Patent No.: US 12,799,398 B2
(45) Date of Patent: Nov. 17, 2026

(54) UPGRADING HYDROCARBON LIQUIDS TO ULTRA-LOW SULFUR NEEDLE COKE

(71) Applicant: ExxonMobil Chemical Patents Inc., Baytown, TX (US)

(72) Inventors: Sundararajan Uppili, Jersey Village, TX (US); Jonathan F. Carpency, Houston, TX (US); Stephen H. Brown, Lebanon, NJ (US)

(73) Assignee: Exxon Mobil Technology and Engineering Company, Spring, TX (US)

( * ) Notice: Subject to any disclaimer, the term of this patent is extended or adjusted under 35 U.S.C. 154(b) by 146 days.

(21) Appl. No.: 18/864,088

(22) PCT Filed: May 2, 2023

(86) PCT No.: PCT/US2023/066468

§ 371 (c)(1),
(2) Date: Nov. 8, 2024

(87) PCT Pub. No.: WO2023/220532

PCT Pub. Date: Nov. 16, 2023

(65) Prior Publication Data

US 2025/0333651 A1 Oct. 30, 2025

Related U.S. Application Data

(60) Provisional application No. 63/341,232, filed on May 12, 2022.

(51) Int. Cl.
*C10B 55/02* (2006.01)
*C10G 45/00* (2006.01)

(52) U.S. Cl.
CPC ..... *C10B 55/02* (2013.01); *C10G 45/00* (2013.01)

(58) Field of Classification Search
CPC ..... C10B 55/00; C10B 257/045; C10G 9/005; C10G 45/00; C10G 45/04; C10G 49/02; C10G 69/06; C10G 2300/802
See application file for complete search history.

(56) References Cited

U.S. PATENT DOCUMENTS 3,817,853 A * 6/1974 Folkins ..... C10G 69/06 208/50
4,832,823 A 5/1989 Goyal et al.
(Continued)

FOREIGN PATENT DOCUMENTS

JP S60149690 A 8/1985
JP 2023508609 A 3/2023
WO 2009001610 A1 12/2008

OTHER PUBLICATIONS

International Search Report and Written Opinion for Application Serial No. PCT/US2023/066468 dated Jul. 21, 2023.
(Continued)

*Primary Examiner* — James C Goloboy
(74) *Attorney, Agent, or Firm* — C. Tumey Law Group PLLC

(57) ABSTRACT

A variety of systems and methods are disclosed, including, in one embodiment, a method of needle coke production. The method includes hydro-processing a hydrocarbon liquid by contacting the hydrocarbon liquid with at least one hydro-processing catalyst in one or more hydro-processing stages to form a hydro-processed product, wherein the hydro-processing of the hydrocarbon liquid in at least one of the one or more hydro-processing stages is performed in the presence of a utility fluid. The hydrocarbon liquid includes an initial boiling point at atmospheric pressure of about 200° C. or greater in accordance with ASTM 7500. The hydrocarbon liquid includes an aromatic content of about 50 wt. % or greater. The method further includes coking at least a
(Continued)

portion of the hydro-processed product to form a coker effluent and coke, wherein the coke comprises needle coke.

18 Claims, 4 Drawing Sheets

(56) References Cited

U.S. PATENT DOCUMENTS

| | | | | |
|---|---|---|---|---|
| 5,286,371 | A * | 2/1994 | Goval | C10G 69/00 208/50 |
| 7,371,317 | B2 * | 5/2008 | Newman | C10B 55/00 208/131 |
| 2015/0368570 | A1 | 12/2015 | Beech et al. | |
| 2019/0016975 | A1 | 1/2019 | Coleman et al. | |
| 2019/0016980 | A1 * | 1/2019 | Kar | C10G 65/00 |

OTHER PUBLICATIONS

International Preliminary Report on Patentability for International Patent Application No. PCT /US2023/066468 dated Nov. 7, 2024. PDF file. 7 pages.

Gunter, Alfke et al. "Oil Refining." Ukkmann's Encyclopedia of Industrial Chemistry vol. 25, Jan. 15, 2007, pp. 208-260. PDF file. 56 pages.

Japanese Office Action for JP Patent Application No. 2024-566608 dated Apr. 7, 2026. English Machine Translation with Original Untranslated Version, PDF file. 8 pages.

* cited by examiner

UPGRADING HYDROCARBON LIQUIDS TO ULTRA-LOW SULFUR NEEDLE COKE

CROSS REFERENCE TO RELATED APPLICATIONS

This application is a national stage application, filed under 35 U.S.C. 371, of International Patent Application No. PCT/US23/66468, filed May 2, 2023, which claims the benefit of and priority to U.S. Provisional Application No. 63/341,232 filed May 12, 2022, the disclosure of which is incorporated herein by reference.

FIELD

Systems and methods are provided for production of needle coke and, more particular, to upgrading hydrocarbon liquids to ultra-low sulfur needle coke by a process that includes hydro-processing with a utility fluid followed by delayed coking.

BACKGROUND

Needle coke is one type of petroleum coke produced in a refinery from thermally cracking long chain hydrocarbons into shorter chain molecules with excess carbon left behind in the form of petroleum coke in a process commonly referred to as "coking." Needle coke is one of the highest value products that can be produced in a refinery and is used to produce various products, including electrodes for arc furnaces and anodes for lithium batteries. Needle coke has conventionally been made in a delayed coker from low sulfur aromatic feedstocks within certain boiling ranges, such as fluid catalytic cracking decant oils, vacuum gas oils, atmospheric residues, and coal tar pitch. These feed streams produce good quality needle coke as they include aromatic molecules resilient to cracking and thus can be coked at higher pressures and longer durations allowing the molecules to condense, align, and form needle coke structures. In contrast, steam cracker tar and other hydrocarbon pyrolysis tars typically have high concentrations of highly reactive molecules and high sulfur content making them not conducive to production of quality needle coke.

SUMMARY

Disclosed herein is an example method of needle coke production. The method comprises hydro-processing a hydrocarbon liquid by contacting the hydrocarbon liquid with at least one hydro-processing catalyst in one or more hydro-processing stages to form a hydro-processed product, wherein the hydro-processing of the hydrocarbon liquid in at least one of the one or more hydro-processing stages is performed in the presence of a utility fluid, wherein the hydrocarbon liquid comprises an initial boiling point at atmospheric pressure of about 200° C. or greater in accordance with ASTM 7500, and wherein the hydrocarbon liquid comprises an aromatic content of about 50 wt. % or greater. The method further comprises coking at least a portion of the hydro-processed product to form a coker effluent and coke, wherein the coke comprises needle coke.

Disclosed herein is another example method of needle coke production. The method comprises hydro-processing a feedstock comprising a steam cracker tar and a utility fluid in a first hydro-processing stage by contacting the feedstock with at least one first stage hydro-processing catalyst in the presence of molecular hydrogen to produce a first stage hydroprocessed effluent, wherein the steam cracker tar has an initial boiling point of about 200° C. or greater, as determined in accordance with ASTM D7500, wherein the steam cracker tar comprises aromatic compounds having ≥15 carbon atoms in an amount of about 50 wt. % or greater, and wherein the utility fluid has a solubility blending number of about 100 or greater and comprises aromatic compounds in an amount of about 25 wt. % or greater. The method further comprises separating at least a first stage hydro-processed product from the first stage hydro-processed effluent. The method further comprises hydro-processing at least a portion of the first stage hydro-processed product in a second hydro-processing stage by contacting the at least a portion of the first stage hydro-processed product with at least one second stage hydro-processing catalyst in the presence of additional molecular hydrogen to produce a second stage hydroprocessed effluent. The method further comprises separating at least a second stage hydro-processed product from the second stage hydro-processed effluent; wherein the second stage hydro-processed product comprises a sulfur content of about 0.5 wt. % or less and has a BMCI of about 90 to about 160, wherein the second stage hydro-processed product comprises an initial boiling point at atmospheric pressure of 300° C. to 400° C. and a final boing point at atmospheric pressure of 500° C. to 600° C., as determined in accordance with ASTM 7500. The method further comprises coking at least a portion of the second stage hydro-processed product to form at least a coker effluent and needle coke, wherein the needle coke comprises sulfur in an amount of 0.5 wt. % or less.

These and other features and attributes of the disclosed methods and systems of the present disclosure and their advantageous applications and/or uses will be apparent from the detailed description which follows.

BRIEF DESCRIPTION OF THE DRAWINGS

To assist those of ordinary skill in the relevant art in making and using the subject matter hereof, reference is made to the appended drawings, wherein.

DETAILED DESCRIPTION

Figure 1:
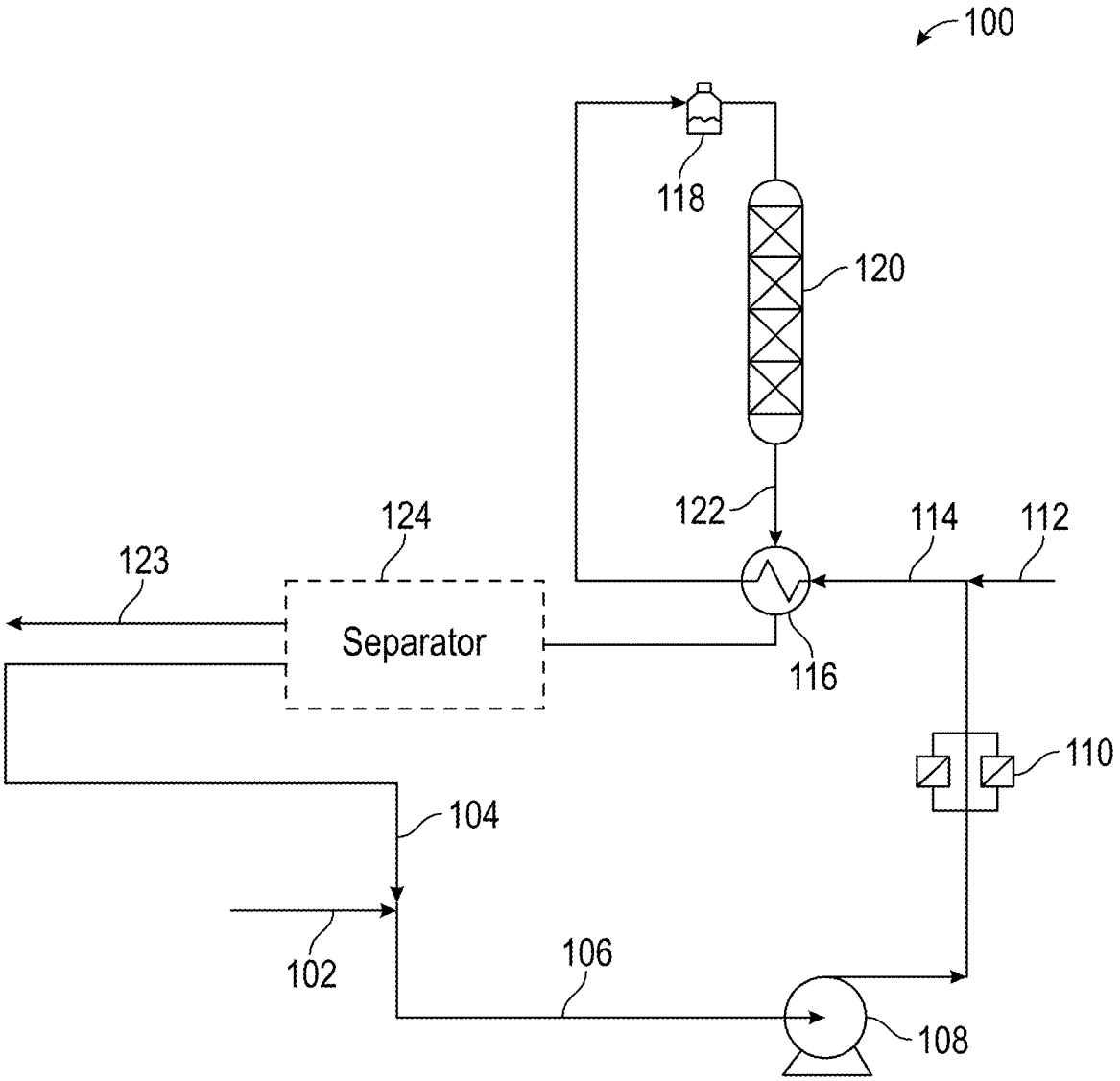
FIG. 1 is an example of a single reaction stage embodiment for upgrading hydrocarbon pyrolysis tar.

Disclosed herein is a process in which hydrocarbon liquids are used to produce needle coke. In accordance with present embodiments, the process for needle coke production includes (i) hydro-processing the hydrocarbon liquid by contacting the hydrocarbon pyrolysis tar with at least one hydro-processing catalyst in one or more hydro-processing stages to form a hydro-processed product; (ii) coking at least a portion of the hydro-processed product to form a coker effluent and coke, wherein the coke comprises needle coke. The hydro-processing used in accordance with present embodiments is a hydrocarbon conversion process referred to as a solvent assisted tar conversion ("SATC") in which the hydrocarbon pyrolysis tar is hydro-processed in the presence of a utility fluid in at least one of the one or more hydro-processing stages. Suitable hydrocarbon liquids include heavy hydrocarbon liquids, such as hydrocarbon pyrolysis tars, atmospheric residues, vacuum residue, slurry oil, and other heavy hydrocarbon stream with high aromatic content.

Hydrocarbon pyrolysis tar is a high-boiling, viscous, hydrocarbon liquid produced from pyrolysis processes, such as steam cracking, in the conversion of saturated hydrocarbons to higher-value products such as light olefins, e.g., ethylene and propylene. Hydrocarbon pyrolysis tars typically include complex, ringed and branched molecules as well as high molecular weight non-volatile components including paraffin insoluble compounds, such as pentane-insoluble compounds and heptane-insoluble compounds, including asphaltenes. Accordingly, the hydrocarbon pyrolysis tars typically contain too many large ring compounds and insufficient quantities of three ring and four ring aromatic compounds, which typically lead to needle coke production. In addition, hydrocarbon tars contain molecules with large numbers of side chains that typical coker feeds for needle coke production, which crack and result in multiple reactive sites for molecular growth propagation, leading to undesirable coke quality. In addition to these compounds, the hydrocarbon pyrolysis tar also includes a high sulfur content, for example, as high as 5 wt. %, leading to production of high-sulfur needle coke that is low in quality.

The SATC process is a hydro-processing technology that addresses fouling caused by feedstocks, such as hydrocarbon pyrolysis tars. Accordingly, example embodiments include hydro-processing the hydrocarbon pyrolysis tar in an SATC process, for example, contacting the hydrocarbon pyrolysis tar with at least one hydro-processing catalysts in one or more hydro-processing stages to form a hydroprocessed product, wherein the hydro-processing in at least one of the one or more hydro-processing stages is performed in the presence of a utility fluid. The SATC is a more "mild" hydrotreating process (e.g., lower pressures and temperatures) than severe hydrotreating (e.g., 20700 kPA) that can convert the hydrocarbon pyrolysis tars to a hydroprocessed product with low sulfur while minimizing aromatic saturations, thus preserving more aromatic rings for coke formation. For example, the hydro-processed product includes sulfur in an amount of ≤1.5 wt. %, ≤1 wt. % or less, ≤0.5 wt. %, ≤0.4 wt. %, or ≤0.1 wt. %. Thus, needle coke produced from coking of the hydro-processed product is also low in sulfur. In addition, needle coke is produced from feeds with high concentrations three-ring and four-ring aromatic compounds with lower concentrations of five and larger ring aromatic compounds. By increasing the concentration of three-ring and four-ring aromatic compounds in the hydroprocessed product to ≥70 wt. %, for example, from the SATC process while reducing concentration of compounds with five or more aromatic rings, coking of the hydroprocessed product advantageously produces needle coke instead of less valuable coke products. BMCI refers to the Bureau of Mines Correlation Index. BMCI is a number correlated with the aromaticity of the feedstock. A coking feedstock with a BMCI of ≥90 can produce desirable needle coke. Advantageously, the SATC process produces a hydroprocessed product with a BMCI of ≥90 in accordance with one or more embodiments.

Hydrocarbon Liquid

In accordance with present embodiments, a hydrocarbon liquid pyrolysis tar is upgraded in a SATC process to provide a hydro-processed product with improved properties for delayed coking. Non-limiting examples of suitable hydrocarbon liquids include heavy hydrocarbon liquids, such as hydrocarbon pyrolysis tars, atmospheric residues, vacuum residue, slurry oil, and other heavy hydrocarbon stream with high aromatic content. Example hydrocarbon liquids have an initial boiling point of ≥200° C. As used herein, the initial and final boiling points are determined in accordance with ASTM D7500. Example hydrocarbon liquids have an aromatics content of ≥50 wt. %, ≥75 wt. %, ≥90 wt. %, ≥95 wt. %, based on the weight of the hydrocarbon liquids. In some embodiments, two or more hydrocarbon liquids are processed in the SATC process.

In some embodiments, a hydrocarbon pyrolysis tar is upgraded in a SATC process to provide a hydro-processed product with improved properties for delayed coking. The hydrocarbon pyrolysis tar includes aromatic compounds. In some embodiments, the hydrocarbon pyrolysis tar includes aromatic compounds having ≥15 carbon atoms in an amount of ≥50 wt. %, ≥75 wt. %, or ≥90 wt. %, based on the weight of the hydrocarbon pyrolysis tar. Hydrocarbon pyrolysis tar generally has a metals content less than crude oil of the same viscosity, for example, hydrocarbon pyrolysis tar has a metals content of $\leq 1.0\times10^3$ ppmw, based on the weight of the hydrocarbon pyrolysis tar, which is an amount of metals that is far less than that found in crude oil (or crude oil components) of the same average viscosity.

In some embodiments, the hydrocarbon pyrolysis tar has an insolubility number ("IN") of ≥80. For example, the hydrocarbon pyrolysis tar can have an IN≥85, IN≥90, IN≥100 IN≥110, IN≥120, IN≥130, or IN≥135. As used herein, the insolubility number or IN is determined in accordance with ASTM D7112.

Additionally, the solubility blending number ("SBN") of the hydrocarbon pyrolysis tar can be as low as SBN≥130, but is typically SBN≥140, SBN≥145, SBN≥150, SBN≥160, SBN≥170, SBN≥175 or even SBN≥180. In some embodiments, the hydrocarbon pyrolysis tar can be one having SBN≥200 or SBN≥200. In further embodiments, the hydrocarbon pyrolysis tar has an SBN up to 240. As used herein the solubility blending number or SBN is determined in accordance with ASTM D7112. With the test method, pentane has an SBN of 25, toluene has an SBN of 100, and quinoline has an SBN of 200.

Further, example embodiments of the hydrocarbon pyrolysis tar include $C_7$ insolubles. In some embodiments, the hydrocarbon pyrolysis tar includes $C_7$ insolubles in an amount of ≤50 wt. %, such as an amount of ≤15 wt. %, ≤25 wt. %, ≤30 wt. %, ≤45 wt. %. Thus, the hydrocarbon pyrolysis tar includes, for example, $C_7$ insolubles in an amount of 15 wt. % to 50 wt. % or 30 wt. % to 50 wt. %.

In particular embodiments, a hydrocarbon pyrolysis tar has an IN of 110 to 135, an SBN of 180 to 240, and a $C_7$ insolubles content of 30 wt. % to 50 wt. %.

As previously mentioned, hydrocarbon pyrolysis tar is generally not used for production of needle coke. Hydrocarbon pyrolysis tar typically contains too many high reactive molecules and too much sulfur making the hydrocarbon pyrolysis tar not conducive for production of high quality coke. For example, the hydrocarbon pyrolysis tar includes sulfur in amount up to 5 wt. % or higher. In some embodiments, hydrocarbon pyrolysis tar includes sulfur in an amount in a range about 1 wt. % to about 7 wt. % or about 2 wt. % to about 4.5 wt. %.

In addition to sulfur, the hydrocarbon pyrolysis tar also includes high molecular weight non-volatile components including paraffin insoluble compounds, such as pentane-insoluble compounds and heptane-insoluble compounds, including asphaltenes, that can lead to undesirable fouling during coking. In some embodiments, hydrocarbon pyrolysis tars contain >0.5 wt. %, sometimes >1 wt. % or even >2 wt. % of toluene insoluble compounds. The high molecular weight compounds are typically multi-ring structures that are also referred to as tar heavies ("TH"). As used herein, the term tar heavies refers to a product of hydrocarbon pyrolysis, having an boiling point at atmospheric pressure of ≥565° C. and comprising ≥5 wt. % of molecules having a plurality of aromatic cores, based on the weight of the product. The tar heavies are typically solid at 25° C. and generally include the fraction of hydrocarbon pyrolysis tar that is not soluble in a 5:1 (vol.:vol.) ratio of n-pentane:hydrocarbon pyrolysis tar at 25.0° C.

Hydrocarbon pyrolysis tar is produced from pyrolysis processes, such as steam cracking, that are utilized for converting saturated hydrocarbons to higher-value products such as light olefins, e.g., ethylene and propylene. Besides these useful products, hydrocarbon pyrolysis can also produce a significant amount of relatively low-value heavy products, such as hydrocarbon pyrolysis tar.

The pyrolysis process for producing the hydrocarbon pyrolysis tar includes, for example, exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, a pyrolysis feedstock comprising ≥10 wt. % hydrocarbon, based on the weight of the pyrolysis feedstock, is subjected to pyrolysis to produce a pyrolysis effluent, which generally contains hydrocarbon pyrolysis tar and ≥1 wt. % of $C_2$ unsaturates, based on the weight of the pyrolysis effluent. The pyrolysis tar generally comprises ≥90 wt. % of the pyrolysis effluent's molecules having an atmospheric boiling point of ≥290° C. Thus, in some embodiments, at least a portion of the hydrocarbon pyrolysis tar is separated from the pyrolysis effluent to produce the feedstock for use in the systems and methods described herein, wherein the feedstock comprises ≥90 wt. % of the pyrolysis effluent's molecules having an atmospheric boiling point of ≥290° C. Besides hydrocarbons, the pyrolysis feedstock optionally further comprises diluent, e.g., one or more of nitrogen, water, etc. For example, the pyrolysis feedstock may further comprise ≥1 wt. % diluent based on the weight of the pyrolysis feedstock, such as ≥25 wt. %. When the diluent includes an appreciable amount of steam, the pyrolysis is referred to as steam cracking.

Example embodiments include a hydrocarbon pyrolysis tar comprising one or more of steam cracked tar, coal pyrolysis tar, and biomass pyrolysis tar. "Steam cracked tar" means hydrocarbon pyrolysis tar obtained from steam cracking, also referred to as steam-cracker tar. "Biomass pyrolysis tar" means hydrocarbon pyrolysis tar obtained from thermal cracking of biomass. "Coal pyrolysis tar" means hydrocarbon pyrolysis tar obtained from thermal cracking of hydrocarbons derived from coal. Alternatively, a hydrocarbon pyrolysis tar can be obtained, e.g., from a steam cracked gas oil ("SCGO") stream and/or a bottoms stream of a steam cracker's primary fractionator, from flash-drum bottoms (e.g., the bottoms of one or more flash drums located downstream of the pyrolysis furnace and upstream of the primary fractionator), or a combination thereof. For example, the hydrocarbon pyrolysis tar can be a mixture of primary fractionator bottoms and tar knock-out drum bottoms.

In some embodiments, a hydrocarbon pyrolysis tar is provided in a pyrolysis effluent. The pyrolysis effluent includes, for example, a hydrocarbon pyrolysis tart (e.g., steam cracker tar) in an amount of ≥90 wt. %, ≥95 wt. %, or ≥99 wt. %, based on the weight of the pyrolysis effluent, with the balance of the pyrolysis effluent being particulates, for example.

In some embodiments, the hydrocarbon pyrolysis tar is a steam cracker tar ("SCT"), for example, having (i) a sulfur content in the range of 0.5 wt. % to 7 wt. %, based on the weight of the SCT; (ii) a tar heavy content in the range of from 5 wt. % to 40 wt. %, based on the weight of the SCT; (iii) a density at 15° C. (as determined in accordance with ASTM D4052) in the range of 1.01 g/cm$^3$ to 1.15 g/cm$^3$, e.g., in the range of 1.07 g/cm$^3$ to 1.20 g/cm$^3$; and (iv) a 50° C. viscosity (as determined in accordance with ASTM D7042) in the range of 200 cSt to $1.0\times10^7$ cSt. The amount of olefin in a SCT is generally ≤10 wt. %, e.g., ≤5 wt. %, such as ≤2 wt. %, based on the weight of the SCT. For example, the amount of (i) vinyl aromatics in a SCT and/or (ii) aggregates in a SCT that incorporates vinyl aromatics is generally ≤5 wt. %, ≤3 wt. %, or ≤2 wt. %, based on the weight of the SCT.

Utility Fluids

In accordance with present embodiments, the hydrocarbon pyrolysis tar is hydro-processed in the presence of a utility fluid. The utility fluid is used in one or more stages of the hydro-processing. The utility fluid can be a defined solvent or can include a defined solvent but is typically a recycle solvent that is taken off from a different process. The utility fluid can be all or partly a product of the present process, such as a mid-cut of the final or intermediate product that is recycled back to the initial feed.

Generally, the utility fluid will include aromatic hydrocarbons and have an ASTM D86 10% distillation point >60° C. and a 90% distillation point <425° C. In accordance with present embodiments, the utility fluid generally includes a mixture of multi-ring compounds. The rings are aromatic or non-aromatic and can contain a variety of substituents and/or heteroatoms. For example, the utility fluid includes aromatics and non-aromatic compounds in an amount of ≥40 wt. %, ≥45 wt. %, ≥50 wt. %, ≥55 wt. %, or ≥60 wt. %, based on the weight of the utility fluid. In some embodiments, the utility fluid comprises aromatic compounds in an amount of ≥25 wt. %, ≥40 wt. %, ≥50 wt. %, ≥55 wt. %, or ≥60 wt. %, based on the weight of the utility fluid.

In particular embodiments, the utility fluid includes one, two, and three ring aromatic compounds. In some embodiments, the utility fluid includes 2-ring and/or 3-ring aromatic compounds in an amount of ≥25 wt. %, ≥40 wt. %, ≥50 wt. %, ≥55 wt. %, or ≥60 wt. %, based on the weight of the utility fluid. The 2-ring and 3-ring aromatics may be used in particular embodiments due to their higher SBN. To the degree that a defined solvent is included in the utility fluid, or used alone, the defined solvent comprises 1- and 2-ring aromatic compound.

The utility fluid can have a true boiling point distribution, for example, having an initial boiling point of ≥177° C. and a final boiling point of ≤566° C. In some embodiments, the utility fluid has a true boiling point distribution having an initial boiling point of ≥177° C. and a final boiling point of ≤430° C. True boiling point distributions ("TBP", the distribution at atmospheric pressure) are determined in accordance with ASTM D7500. When the final boiling point is greater than that specified in the standard, the true boiling point distribution can be determined by extrapolation.

Generally, increased non-aromatic content of utility fluids having a relatively low initial boiling point, such as those where ≥10 wt. % of the utility fluid has an atmospheric boiling point <175° C., can lead to incompatibility with hydrocarbon pyrolysis tars and asphaltene precipitation. Accordingly, the utility fluid has a true initial boiling point of ≥177° C., in accordance with present embodiments. Likewise, since generally higher SBN molecules are required to avoid incompatibility with high Ix tars and higher boiling point molecules have higher SBN, the utility fluid has a true final boiling point of ≤566° C., in accordance with present embodiments. Optionally, the utility fluid has a true final boiling point of >430° C. Such utility fluids have more than the typical aromatic content, for example, 2- and 3-ring aromatic compounds in an amount of ≥25 wt. %, based on the weight of the utility fluid.

As previously described, the hydrocarbon pyrolysis tar is hydro-processed in the presence of a utility fluid in one or more stages of the hydro-processing. In some embodiments, the utility fluid is employed during hydro-processing in an amount of 5 wt. % to 80 wt. %, based on total weight of utility fluid plus hydrocarbon pyrolysis tar, while the hydrocarbon pyrolysis tar is used in an amount of 20 wt. % to 95 wt. %, based on total weight of utility fluid plus hydrocarbon pyrolysis tar. For example, the relative amounts of utility fluid and tar stream during hydro-processing include hydrocarbon pyrolysis tar in an amount of 20 wt. % to 90 wt. % and utility fluid in an amount of 10 wt. % to 80 wt. %. By way of further example, the relative amounts of utility fluid and tar stream during hydro-processing include hydrocarbon pyrolysis tar in an amount of 40 wt. % to 90 wt. % and utility fluid in an amount of 10 wt. % to 60 wt. % of the utility fluid. In some embodiments, the utility fluid:hydrocarbon pyrolysis weight ratio is ≥0.01, e.g., in the range of 0.05 to 4, such as in the range of 0.1 to 3 or 0.3 to 1.1. At least a portion of the utility fluid can be combined with at least a portion of the hydrocarbon pyrolysis tar within the hydro-processing vessel or hydro-processing stage, but this is not required, and in one or more embodiments at least a portion of the utility fluid and at least a portion of the hydrocarbon pyrolysis tar are supplied as separate streams and combined into one feed stream prior to entering (e.g., upstream of) the hydro-processing stage(s). For example, the tar stream and utility fluid can be combined to produce a feedstock upstream of the hydro-processing stage, the feedstock comprising, e.g., hydrocarbon pyrolysis tar in an amount of 20 wt. % to 90 wt. % and utility fluid in an amount of 10 wt. % to 80 wt. % or hydrocarbon pyrolysis tar in an amount of 40 wt. % to 90 wt. % and utility fluid in an amount of 10 wt. % to 60 wt. %, the weight percents being based on the weight of the feedstock.

Compatibility of a utility fluid and hydrocarbon pyrolysis tar is based on comparing the SBN of a mixture of the utility fluid and hydrocarbon pyrolysis tar with the IN of the hydrocarbon pyrolysis tar. In some embodiments, the utility fluid has an SBN of ≥100, ≥110, ≥120, ≥130, ≥140, ≥150, or ≥160. In some embodiments, the combined pyrolysis tar and utility fluid has an SBN≥110. Thus, it has been found that there is a beneficial decrease in reactor plugging when hydro-processing pyrolysis tars having incompatibility number ($I_N$)>80 if, after being combined, the utility fluid and hydro-processing pyrolysis tar mixture has a SBN of ≥110, ≥120, or ≥130. Additionally, it has been found that there is a beneficial decrease in reactor plugging when hydro-processing pyrolysis tars having incompatibility number ($I_N$) >110 if, after being combined, the utility fluid and tar mixture has a high SBN, such as ≥150, ≥155, or ≥160.

In some embodiments, the utility fluid may be obtained as a mid-cut stream separated from a first hydro-processed product, for example, from a first hydro-processing stage. Thus, the examples embodiments of the process provided herein includes separating the first hydro-processed product in one or more separation stages into an overhead stream, a mid-cut stream and a bottoms stream. For example, the first hydro-processed product may first be separated (e.g., in a flash drum) into a vapor portion and liquid portion, and the liquid portion may then be separated (e.g., in a distillation column) into the overhead stream, the mid-cut stream and the bottoms stream.

A mid-cut stream's SBN is be affected by hydro-processing conditions. For example, as conditions are adjusted to (e.g., higher pressure, lower WHSV) to improve the product quality, the mid-cut stream may become further hydrogenated, which may reduce the mid-cut stream's SBN. A reduced SBN of the mid-cut stream can be problematic when blending with the hydrocarbon pyrolysis tar because a lower SBN can render the mid-cut stream incompatible with the hydrocarbon pyrolysis tar, which can lead to fouling and plugging of the reactor. However, a process using at least two hydro-processing stages, where the mid-cut stream is separated from the first hydro-processed stage as described herein can produce a mid-cut stream having a composition and a boiling range rendering it useful as a utility fluid in various hydrocarbon conversion process, e.g., hydro-processing. In some embodiments, the mid-cut stream has an SBN of ≥100, ≥110, ≥120, ≥130, ≥140, ≥150, or ≥160.

Thus, at least a portion of the mid-cut stream is recycled (i.e., interstage recycle) as an interstage hydro-processed product for use as the utility fluid in the first hydro-processing stage, in accordance with some embodiments. For example, ≥20 wt. %, ≥30 wt. %, ≥40 wt. %, ≥50 wt. %, ≥60 wt. %, ≥70 wt. %, or ≥80 wt. % of the mid-cut stream is recycled for use as the utility fluid in the first hydro-processing stage.

In some embodiments, a supplemental utility fluid is under certain operating conditions, e.g., when starting the process (until sufficient utility fluid is available from the first hydro-processed product as the mid-cut stream), or when operating at higher reactor pressures. Accordingly, a supplemental utility fluid, such as a solvent, a solvent mixture, steam cracked naphtha (SCN), steam cracked gas oil (SCGO), or a fluid comprising aromatics (i.e., comprises molecules having at least one aromatic core) may optionally be added, e.g., to start-up the process. In some embodiments, the supplemental utility fluid comprises ≥50 wt. %, ≥75 wt. %, or ≥90 wt. % of aromatics and/or non-aromatics, based on the weight of the supplemental utility fluid. The supplemental utility fluid can have an ASTM D86 10% distillation point of ≥60° C. and a 90% distillation point of ≤350° C. Optionally, the supplemental utility fluid (which can be a solvent or mixture of solvents) has an ASTM D86 10% distillation point ≥120° C., ≥140° C., or ≥150° C. and/or an ASTM D86 90% distillation point of ≤300° C.

Optionally, the supplemental utility fluid comprises >90 wt. % based on the weight of the utility fluid of one or more of benzene, ethylbenzene, trimethylbenzene, xylenes, toluene, naphthalenes, alkylnaphthalenes (e.g., methylnaphthalenes), tetralins, or alkyltetralins (e.g., methyltetralins), e.g., ≥95 wt. %, such as ≥99 wt. %. It is generally desirable for the supplemental utility fluid to be substantially free of molecules having alkenyl functionality, particularly in aspects utilizing a hydro-processing catalyst having a tendency for coke formation in the presence of such molecules. In certain aspects, the supplemental utility fluid comprises ≤10 wt. % of ring compounds having $C_1$-$C_6$ sidechains with alkenyl functionality, based on the weight of the utility fluid. One suitable supplemental utility fluid is A200 solvent, available from ExxonMobil Chemical Company (Houston, Tex.) as Aromatic 200, CAS number 64742-94-5.

SATC Process

The systems and methods include hydro-processing a hydrocarbon liquid (e.g., hydrocarbon pyrolysis tar) by contacting the hydrocarbon pyrolysis tar in the presence of a treat gas comprising hydrogen with at least one hydro-processing catalysts in one or more hydro-processing stages to form a hydro-processed product. The hydro-processing is referred to as a solvent assisted tar conversion ("SATC") processed because at least of the one or more hydro-processing stages includes hydro-processing the hydrocarbon pyrolysis tar in the presence of a utility fluid. The feedstock comprises hydrocarbon pyrolysis tar, e.g., ≥10 wt. % hydrocarbon pyrolysis tar based on the weight of the feedstock, and can include >15 wt. %, >20 wt. %, >30 wt. % or up to about 50 wt. % hydrocarbon pyrolysis tar.

The hydro-processing is carried out under hydro-processing conditions, e.g., under conditions for carrying out one or more of hydrocracking (including selective hydrocracking), hydrogenation, hydrotreating, hydrodesulfurization, hydro-denitrogenation, hydro demetallation, hydrodearomatization, hydroisomerization, or hydrodewaxing. Hydro-processing is carried out in the at least one reaction stages in series. In some embodiments, hydro-processing is carried out in at least one reaction stage in series. The two reaction stages are typically in two reactors, but can be set up in two parts of a single reactor so long as the mid-cut is separated and removed between the first and second stage.

In multi-stage embodiments, the hydro-processing is performed in a first hydro-processing stage by contacting the feedstock with at least one hydro-processing catalyst in the presence of a utility fluid and molecular hydrogen under catalytic hydro-processing conditions to convert at least a portion of the feedstock to a first hydro-processed product. A mid-cut stream is separated from the first hydro-processed product. In some embodiments, the mid-cut stream includes ≥ about 20 wt. % of the first hydro-processed product and has a boiling point distribution from about 120° C. to about 480° C. as measured according to ASTM D7500. In some embodiments, the mid-cut is recycled as utility fluid in the in the first hydro-processing stage. In some embodiments, a bottoms stream is also separated from the first hydro-processed product. The bottoms stream includes, for example, the first hydro-processed product in an amount of ≥about 20 wt. %. At least a portion of the bottoms stream in hydro-processed in a second hydro-processing stage by contacting the bottoms stream with at least one hydro-processing catalyst in the presence of molecular hydrogen under catalytic hydro-processing conditions to convert at least a portion of the bottoms stream to a second hydro-processed product.

The SATC process enables the production of a hydro-processed product (SATC product) with desirable properties for production of needle coke. The hydro-processed product is the second hydro-processed product in the multi-stage embodiments. For example, the hydro-processed product is low in sulfur and has increased concentrations of three-ring and four-ring aromatic compounds. In some embodiments, the hydro-processed product has a sulfur content of ≤1.5 wt. %, ≤1 wt. %, ≤0.5 wt. %, ≤0.4 wt. %, ≤0.1 wt. % or less, based on weight of the hydro-processed product. In some embodiments, the hydro-processed product has increased content of three-ring and four-ring aromatic compounds. Examples of the hydro-processed product include three-ring and four-ring aromatic compounds in a combined amount of ≥50 wt. %, ≥60 wt. %, or ≥70 wt. %, based on the weight of the hydro-processed product. Another measure to quantity aromaticity is BMCI. In some embodiments, the hydro-processed product has a BMCI of ≥90, ≥100, ≥110, ≥120, for example of 90 to 160 or 120 to 160.

The hydro-processed product can also be low in ash, for example, having an ash content of ≤0.5 wt. %, ≤0.3 wt. % less, ≤0.1 wt. %, or less, based on weight of the hydro-processed product. In some examples, the hydro-processed product also has an initial boiling point at atmospheric pressure of 200° C. to 400° C. and a final point at atmospheric pressure of 500° C. to 700° C. For example, the hydro-processed product can have an initial boiling point of 250° C. to 375° C., or 275° C. to 375° C. By way of further example, the hydro-processed product can have a final boiling point of 525° C. to 675° C., or 525° C. to 600° C. Example hydro-processed product also has a product viscosity of ≤30 cSt at 50° C., ≤20 cSt at 50° C., or ≤15 cSt at 50° C. and a density of ≤1.00 g/cm$^3$.

In any configuration of the process, the hydro-processing conditions can include a temperature, for example, of 200° C.-450° C. In some embodiments, independently, or in combination with any particular arrangement of the catalysts in the different hydro-processing stages, the temperature in the first hydro-processing stage can range from about 200° C.-450° C. or about 200° C.-425° C. and the temperature in the second hydro-processing stage can range from about 300° C.-450° C. or about 350° C.-425° C. and vice versa. In some embodiments, the temperature in the first hydro-processing stage can be higher than the temperature in the second hydro-processing stage and vice versa. Alternatively, the temperature may be the same in the first and second hydro-processing stages.

In any configuration of the process, the hydro-processing conditions can include a pressure, for example, of 4100 kPa to 14000 kPa, 4100 kPa to 1300 kPa, 5500 kPa to 11000 kPa, 7000 kPa to 9650 kPa, 7000 kPa to 8200 kPa, 7500 kPa to 11000 kPa, 7500 kPa to 8950 kPa. In some embodiments a pressure of 7000 kPa to 8950 kPa is used in a process, for example, where hydrotreating is predominately applied in a first stage followed by hydrocracking process. In some embodiments, a catalyst promoting a hydrotreating reaction comprises Ni and the pressure can be >14000 kPa.

Any of a variety of suitable hydro-processing catalysts can be utilized for hydro-processing the feedstock (e.g., pyrolysis tar) in the SATC process described herein. Suitable hydro-processing catalysts include those comprising (i) one or more bulk metals and/or (ii) one or more metals on a support. The metals can be in elemental form or in the form of a compound. In one or more embodiments, the hydro-processing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of ≥0.00001 grams, or ≥0.01 grams, or ≥0.02 grams, in which grams are calculated on an elemental basis. For example, the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst can contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Additionally, the catalyst may further comprise inorganic oxides, e.g., as a binder and/or support. For example, the catalyst can comprise (i)≥1 wt. % of one or more metals selected from Groups 6, 8, 9, and 10 of the Periodic Table and (ii)≥1 wt. % of an inorganic oxide, the weight percents being based on the weight of the catalyst.

In one or more embodiments, the catalyst (e.g., in the first and/or second hydro-processing stage) is a bulk multi-metallic hydro-processing catalyst with or without binder. In an embodiment the catalyst is a bulk tri-metallic catalyst comprised of two Group 8 metals, preferably Ni and Co and one Group 6 metal, preferably Mo.

Example embodiments also include incorporating into (or depositing on) a support one or catalytic metals e.g., one or more metals of Groups 5 to 10 and/or Group 15, to form the hydro-processing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydro-processing catalyst (e.g., in the first and/or second hydro-processing stage) is a supported catalyst, and the support comprises at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise ≥0.1 grams, or ≥0.3 grams, or ≥0.5 grams, or ≥0.8 grams of theta alumina.

When a support is utilized, the support can be impregnated with the desired metals to form the hydro-processing catalyst. The support can be heat-treated at temperatures in a range of from 400° C. to 1200° C., or from 450° C. to 1000° C., or from 600° C. to 900° C., prior to impregnation with the metals. In certain embodiments, the hydro-processing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydro-processing catalyst. Typically, such heat treating is conducted at temperatures ≤1200° C.

In one or more embodiments, the hydro-processing catalysts usually include transition metal sulfides dispersed on high surface area supports. The structure of the typical hydrotreating catalysts is made of 3 wt. % to 15 wt. % Group 6 metal oxide and 2 wt. % to 8 wt. % Group 8 metal oxide and these catalysts are typically sulfided prior to use.

The catalyst can be in shaped forms, e.g., one or more of discs, pellets, extrudates, etc., though this is not required. Non-limiting examples of such shaped forms include those having a cylindrical symmetry with a diameter in the range of from 0.79 mm to 3.2 mm, from 1.3 mm to 2.5 mm, or from 1.3 mm to 1.6 mm. Similarly sized non-cylindrical shapes are also contemplated herein, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are used in one or more embodiments. When a porous catalyst is utilized, the catalyst can have a pore structure, pore size, pore volume, pore shape, pore surface area, etc., in ranges that are characteristic of conventional hydro-processing catalysts, though the invention is not limited thereto. Since feedstock (e.g., pyrolysis tar) can include fairly large molecules, catalysts with large pore size are preferred, especially at reactor locations where the catalyst and feed first meet. For example, the catalyst can have a median pore size that is effective for hydro-processing SCT molecules, such catalysts having a median pore size in the range of from 30 Å to 1000 Å, or 50 Å to 500 Å, or 60 Å to 300 Å. Further, catalysts with bi-modal pore system, having 150-250 Å pores with feeder pores of 250-1000 Å in the support are more favorable. Pore size can be determined according to ASTM Method D4284-07 Mercury Porosimetry.

In a particular embodiment, the hydro-processing catalyst (e.g., in the first and/or second hydro-processing stage) has a median pore diameter in a range of from 50 Å to 200 Å.

Alternatively, the hydro-processing catalyst has a median pore diameter in a range of from 90 Å to 180 Å, or 100 Å to 140 Å, or 110 Å to 130 Å. In another embodiment, the hydro-processing catalyst has a median pore diameter ranging from 50 Å to 150 Å. Alternatively, the hydro-processing catalyst has a median pore diameter in a range of from 60 Å to 135 Å, or from 70 Å to 120 Å. In yet another alternative, hydro-processing catalysts having a larger median pore diameter are utilized, e.g., those having a median pore diameter in a range of from 180 Å to 500 Å, or 200 Å to 300 Å, or 230 Å to 250 Å.

Generally, the hydro-processing catalyst has a pore size distribution that is not so great as to significantly degrade catalyst activity or selectivity. For example, the hydro-processing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydro-processing catalyst can have a surface area >60 $m^2/g$, or ≥100 $m^2/g$, or >120 $m^2/g$, or >170 $m^2/g$, or >220 $m^2/g$, or >270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydro-processing catalysts for use in the hydro-processing stages can be used, but the invention is not limited thereto. In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source. However, the invention is not limited to only these catalysts.

In a particular embodiment, the catalyst in the first hydro-processing stage can be one that comprises one or more of Ni, Mo, W, Pd, and Pt, supported on amorphous $Al_2O_3$ and/or $SiO_2$ (ASA). Example catalysts for use in a hydro-processing stage, which hydro-processing can be the first treatment applied to the hydrocarbon pyrolysis tar, are a Ni—Co—Mo/$Al_2O_3$ type catalyst, or Pt—Pd/$Al_2O_3$—$SiO_2$, Ni—W/$Al_2O_3$, Ni—Mo/$Al_2O_3$, or Fe, Fe—Mo supported on a non-acidic support such as carbon black or carbon black composite, or Mo supported on a nonacidic support such as $TiO_2$ or $Al_2O_3/TiO_2$.

In a particular embodiment, the catalyst in the second hydro-processing stage can be one that comprises predominantly one or more of a zeolite or Co, Mo, P, Ni, Pd supported on ASA and/or zeolite. Example catalysts for use in the second hydro-processing stage are USY or VUSY Zeolite Y, Co—Mo/$Al_2O_3$, Ni—Co—Mo/$Al_2O_3$, Pd/ASA-Zeolite Y. The catalyst for each hydro-processing stage maybe selected independently of the catalyst used in any other hydro-processing stage; for example, RT-228 catalyst may be used in the first hydro-processing stage, and RT-621 catalyst may be used in the second hydro-processing stage.

In some embodiments, a guard bed comprising an inexpensive and readily available catalyst, such as Co—Mo/$Al_2O_3$, followed by $H_2S$ and $NH_3$ removal is needed if the S and N content of the feed is too high and certain catalysts are used in the hydro-processing stage (e.g., a zeolite). However, the guard bed may not be necessary when a zeolite catalyst is used in the second reactor because the sulfur and nitrogen levels will already be reduced in the first reactor. Steps for $NH_3$ and $H_2S$ separation can still be applied to the products of both of the first hydro-processing stage and the second hydro-processing stage if desired.

In another particular embodiment, the catalyst in the first hydro-processing stage can be one that comprises predominantly one or more of a zeolite or Co, Mo, P, Ni, Pd supported on ASA and/or zeolite, and the catalyst in the second hydro-processing stage can be one that comprises one or more of Ni, Mo, W, Pd, and Pt, supported on amorphous $Al_2O_3$ and/or $SiO_2$ (ASA). In this configuration, the exemplary catalysts for use in the first hydro-processing stage are USY or VUSY Zeolite Y, Co—Mo/$Al_2O_3$, Ni—Co—Mo/$Al_2O_3$, Pd/ASA-Zeolite Y and exemplary catalysts for use in the second hydro-processing stage are a Ni—Co—Mo/$Al_2O_3$ type catalyst, or Pt—Pd/$Al_2O_3$—$SiO_2$, Ni—W/$Al_2O_3$, Ni—Mo/$Al_2O_3$, or Fe, Fe—Mo supported on a non-acidic support such as carbon black or carbon black composite, or Mo supported on a nonacidic support such as $TiO_2$ or $Al_2O_3/TiO_2$. The catalyst for each hydro-processing stage maybe selected independently of the catalyst used in any other hydro-processing stage; for example, RT-621 catalyst may be used in the first hydro-processing stage, and RT-228 catalyst may be used in the second hydro-processing stage.

In another embodiment, the catalyst in the first hydro-processing stage can be the same catalyst or perform a similar function as the catalyst in the second hydro-processing stage.

Delayed Coking

Example embodiments include feeding at least a portion of the hydro-processed product into a delayed coking unit. After hydro-processing the hydro-processed product has a low sulphur concentration, e.g., 1.5 wt. %, 1 wt. %. 0.5 wt. %. 0.1 wt. %, or less, and increased levels of three and four ring aromatic molecules desirable for needle coke production. In the delayed coking unit, the hydroprocessed product is processed by way of delayed coking to produce a coke effluent in the form of liquid and vapor products, as well as coke. Delayed coking of the hydro-processed product is carried out by converting part of the hydro-processed product to more valuable hydrocarbon products. The resulting coke has value, depending on its grade, as a fuel (fuel grade coke), electrodes for aluminum manufacture (anode grade coke), etc. In accordance with present embodiments, the coke comprises needle coke.

In some embodiments, the hydroprocessed product is co-fed to the delayed coking unit with a conventional coker feed. Examples of suitable convention coker feeds, include, but are not limited, decant oils, vacuum gas oils, atmospheric residues, and coal tar pitch. The conventional coker fed may be cofed at any suitable ratio, including a hydro-processed product to coker feed ratio of about 5:95 to 95:5, 25:75 to 75:25, or 40:60 to 60:40.

In some embodiments, the hydro-processed product is pre-heated and then conducted to a coking zone. The hydro-processed product is pre heated to any suitable temperature for coking, such as a temperature of 480° C. to 570° C. In some embodiments, pre-heating includes passing the hydro-processed product through a furnace. In some embodiments, preheating includes pumping the hydro-processed product to a bottom of a coking fractionator and then to the furnace. From the furnace, the pre-heated hydro-processed product is passed to a coking zone. In some embodiments, the coking zones includes a coking vessel, such as a vertically-oriented, insulated coker vessel, often referred to as a coking drum. For example, the pre-heated hydro-processed product is passed from the furnace to the coking drum through an inlet at the base of the drum. In accordance with present embodiments, the coking zone (e.g., coking drum) is operated at coking condition. Example coking conditions in the coking zone include a pressure ranging from, such as 100 kPa to 1200 kPa, 100 kPa to 550 kPa, or 100 kPa to 240 kPa. Higher pressures may also be used. For example, coking conditions in the coking zone may be as high as 1200 kPa to 8000 kPa. Typical operating temperatures of the coking zone will be between 400° C. to 550° C., 400° C. to 475° C. or 450° C. to 475° C. The preheated hydro-processed product thermally cracks over a period of time (the "coking time") in the coke, liberating volatiles composed primarily of hydrocarbon products that continuously rise through the coke bed, which consists of channels, pores and pathways, and are collected overhead as a coker effluent. The coking time varies, for example, based on temperature and pressure. In some embodiments, the coking time is 5 hours to 48 hours or 8 hours to 16 hours.

In some embodiments, the coker effluent is conducted to a coker fractionator for distillation and recovery of fluid coker products, including coker gases, coker naphtha, coker distillate, and coker gas oil. Such fractions can be used, usually, but not always, following upgrading, in the blending of fuel and lubricating oil products such as motor gasoline, motor diesel oil, fuel oil, and lubricating oil. Upgrading can include separations, heteroatom removal via hydrotreating and non-hydrotreating processes, de-aromatization, solvent extraction, and the like. The coker gases, include, for example, a mixture of hydrocarbons comprising 1 carbon to 4 carbons, as well as hydrocarbon and carbon dioxide. The coker gas oil includes, for example, light coker gas oil and heavy coker gas oil. In some embodiments, at least a portion of the heavy coker gas oil in the coker effluent introduced into the coker fractionator can be captured for recycle and combined with the fresh feed of the hydroprocessed product, thereby forming the coker heater or coker furnace charge. In some embodiments, there is no recycle and, in some embodiments, the recycle of the heavy gas oil can be up to 200 vol % of the hydro-processed product, such as recycling the heavy gas oil in an amount of 5 vol % to 35 vol % of the hydro-processed product.

In addition to the volatile products, the process also results in the accumulation of coke in the coking zone (e.g., coking vessel). At periodic intervals, for example, when a predetermined coke accumulation is obtained, the preheated hydro-processed product is switched to another coking vessel and hydrocarbon vapors are purged from the coking vessel with steam. In some embodiments, the coking vessel is then quenched with water to lower the temperature below 150° C., for example, to 95° C. to 150° C., after which the water is drained. When the draining step is complete, the drum is opened and the coke is removed, for example, by drilling and/or cutting using high velocity water jets ("hydraulic decoking"). As previously mentioned, the coke produced in the delayed coking of the hydroprocessed product includes needle coke.

Needle Coke

Needle coke is produced by the delayed coking of the hydro-processed product from the SATC process. For example, the coke product produced in the delayed coking comprises needle coke in an amount of about 20 wt. %, 25 wt. %. 35 wt. %. 40 wt. %, 50 wt. %, 60 wt. %, or more. In some embodiments, the coke product comprises needle coke in an amount of 25 wt. % to 60 wt. %. Needle coke is type of coke formed in delayed coking having an acicular, anisotropic microstructure. Under a microscope, fibrous structures are observed in needle coke. Needle coke can be converted to graphite for use in electrodes by a graphitization process that includes heating to high temperatures above 2000° C. Electrodes produced from needle coke are used in arc furnaces to melt steel, as well as the anode in lithium batteries.

The particular composition of the needle coke depends on a number of factors, including the particular coking conditions, such as the delayed coking conditions and feed composition. In some embodiments, the needle coke includes carbon in an amount of 80 wt. % to 98 wt. % based on a total weight of the coke. (>90%) Because the hydro-processed product is low in sulfur, the needle coke is also low in sulfur. For example, the needle coke includes sulfur in an amount of ≤1.5 wt. %, ≤1 wt. % or less, ≤0.5 wt. %, ≤0.4 wt. %, or ≤0.1 wt. %. In addition, the needle coke should also have a low ash content. For example, the needle coke has an ash content of about <0.4, <0.2, <0.1, or less.

Configuration Examples

FIG. 1 illustrates an example single-stage hydro-processing system 100 for hydro-processing of a hydrocarbon pyrolysis tar. In the illustrated embodiment, a tar feed 102 comprising a hydrocarbon pyrolysis tar (e.g., steam cracked tar) to be processed is blended with a recycle fluid 104 comprising a utility fluid to form a feedstock 106. While not shown. make-up utility fluid may also be used in addition to the recycle fluid 104. The feedstock 106 is then pumped by way of pump 108 through a filter 110. The filter 110 includes, for example, one or more of guard bed and/or $H_2S/NH_3$ removal. A treat gas 112 comprising molecular hydrogen is then added to the feedstock 106 to form a hydrogen-rich feedstock 114. This stream is referred to as being "hydrogen-rich" in that has been enriched with hydrogen to include more hydrogen after combination with the treat gas 112. The molecular hydrogen can be added to the feedstock 106 at any suitable ratio, for example, to maintain a $H_2$ partial pressure of from 4820 kpa to 10350 kpa in the hydro-processing reactor 120.

The hydrogen-rich feedstock 114 is then passed through a first heat exchanger 116 and then a second heat exchanger 118 to pre-heat the hydrogen-rich feedstock 114. The hydrogen-rich feedstock 114 that has been pre-heated is then fed into a hydro-processing reactor 120 containing a hydro-processing catalyst. While FIG. 1 illustrates introducing the hydrogen-rich feedstock 114 comprising the hydrocarbon pyrolysis tar, utility fluid, and hydrogen in a combined stream, it should be understood that embodiments include separately introducing one or more of these components to the hydro-processing reactor 120. For example, at least a portion of the treat gas 112 can be introduced into the hydro-processing reactor 120 for intercooling. The single-stage hydro-processing system 100 is considered as having a single hydro-processing stage because it includes only one of the hydro-processing reactor 120. The hydro-processing reactor 120 can operated at any suitable hydro-processing conditions, as described above. In the hydro-processing reactor 120, the hydrocarbon pyrolysis tar is hydro-processed by contact with at least one hydro-processing catalyst in the presence of the utility fluid and the hydrogen to form a hydro-processed product. A hydro-processed effluent 122 comprising the hydroprocessed product is conducted from the hydro-processing reactor 120 through the first heat exchanger 116 to separator 124 (e.g., a distillation tower). In the separator 124. a hydro-processed product 122 is separated from the hydro-processed effluent 122 with the recycle fluid 104 being recycled for mixture with the tar feed 102. While not shown, additional separators (e.g., a flash drum) may be used. for example, to remove hydrogen from the hydro-processed effluent 122. Advantageously, the hydro-processed product 123 has desirable characteristics, e.g., higher concentration of three ring and four ring aromatic molecules and low sulfur, such that it can be coked to form needle coke with less fouling and higher needle coke production than coking of a hydrocarbon pyrolysis tar that has not been hydroprocessed.

Figure 2:
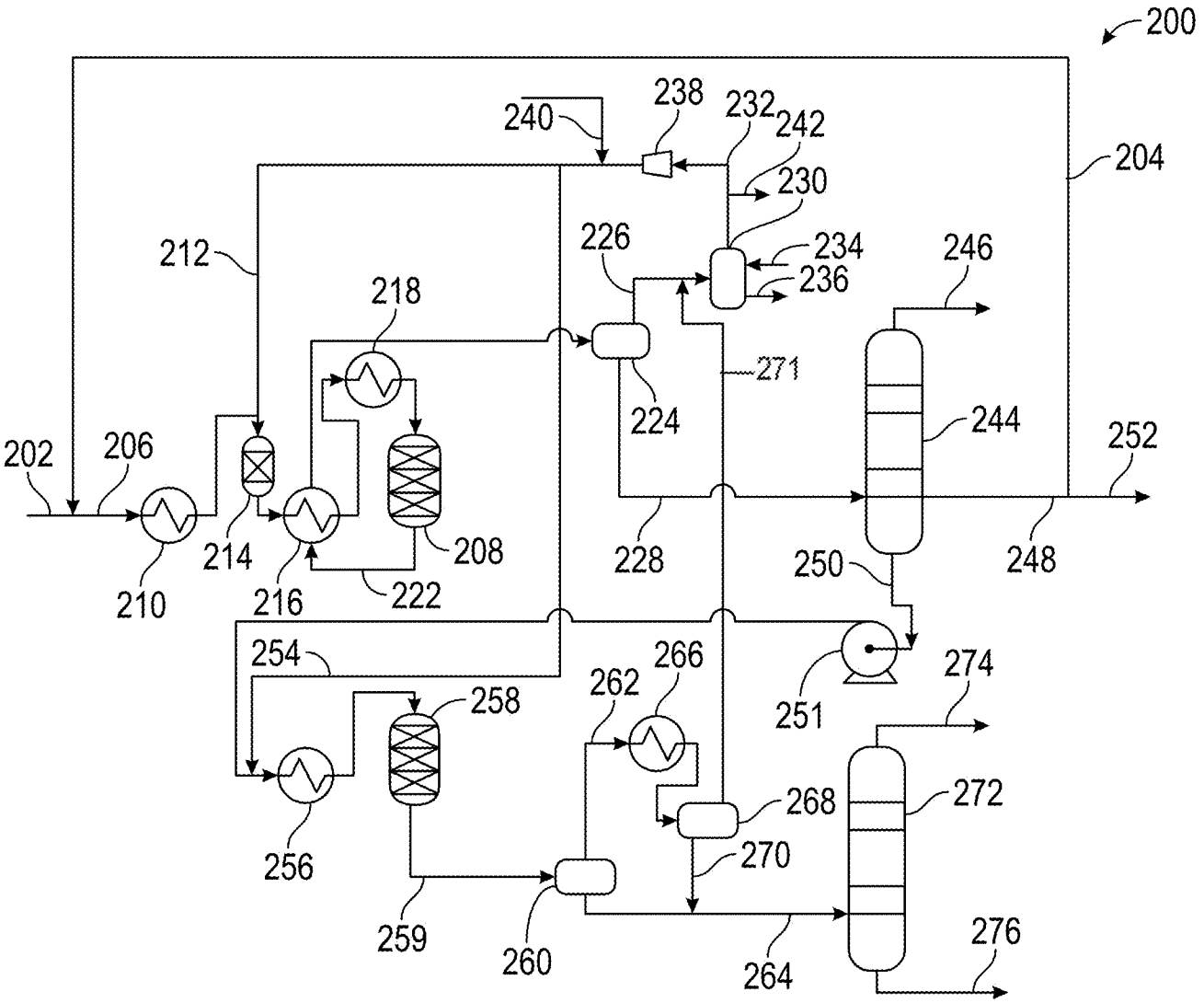
FIG. 2 is an example for upgrading hydrocarbon pyrolysis tar in at least two reaction stages.

FIG. 2 illustrates an example of a multi-stage hydro-processing system 200. In the illustrated embodiment, a tar feed 202 comprising a hydrocarbon pyrolysis tar (e.g., steam cracked tar) to be processed is blended with a recycle fluid 204 comprising a utility fluid to form a feedstock 206. The feedstock 206 is provided to a first hydro-processing reactor 208 comprising a hydro-processing catalyst. The feedstock 206 stream optionally may first be heated in a first heat exchanger 210. A treat gas 212 comprising molecular hydrogen is then added to the feedstock 206 to form a hydrogen-rich feedstock 214. This stream is referred to as being "hydrogen-rich" in that has been enriched with hydrogen to include more hydrogen after combination with the treat gas 212. The molecular hydrogen can be added to the feedstock 206 at any suitable ratio, for example, to maintain a $H_2$ partial pressure of from 4820 kpa to 10350 kpa in the first hydro-processing reactor 208. The hydrogen-rich feedstock 214 is then passed through a second heat exchanger 216 and then a feed heater 218 to pre-heat the hydrogen-rich feedstock 214. The hydrogen-rich feedstock 214 that has been pre-heated is then fed into the first hydro-processing reactor 208 containing a hydro-processing catalyst.

While FIG. 2 illustrates introducing the hydrogen-rich feedstock 214 comprising the hydrocarbon pyrolysis tar, utility fluid, and hydrogen in a combined stream, it should be understood that embodiments include separately introducing one or more of these components to the first hydro-processing reactor 208. For example, at least a portion of the treat gas 212 can be introduced into the first hydro-processing reactor 208 for intercooling. The first hydro-processing reactor 208 can operated at any suitable hydro-processing conditions, as described above. In the first hydro-processing reactor 208, the hydrocarbon pyrolysis tar is hydro-processed by contact with at least one hydro-processing catalyst in the presence of the utility fluid and the hydrogen to form a first hydro-processed product. A first stage hydro-processed effluent 222 comprising the first hydro-processed product is conducted from the first hydro-processing reactor 208 through the second heat exchanger 216.

The first stage hydro-processed effluent 222 is cooled in the second heat exchanger 216 (e.g., by cross-exchange with the hydrogen-rich feedstock 214). Following cooling, the first stage hydro-processed effluent 222 is conducted to a first separator 224 for separating first stage vapor product 226 (e.g., heteroatom vapor, vapor-phase cracked products, unused treat gas, etc.) and first stage liquid effluent 228 from the first stage hydro-processed effluent 222. In one embodiment, the first separator 224 is a flash drum. The first stage vapor product 226 is optionally conducted to an amine tower 230 (e.g., $H_2S$ scrubber) to produce upgraded treat gas stream 232 (e.g., hydrogen) substantially free of $H_2S$. Fresh amine 234 (e.g., monoethanolamine, methyldiethanolamine, diethanolamine, etc.) is provided to the amine tower 230 and rich amine 236 comprising $H_2S$ is conducted away from the amine tower 230. At least a portion of the upgraded treat gas stream 232 is optionally conducted away from amine tower 230, compressed in compressor 238, and re-used during hydro-processing in the first and/or second stage, for example, as treat gas 212. Gas, e.g., molecular hydrogen for starting up the process or for make-up, can be obtained from feed treat gas stream 240, if needed, for example, and mixed with treat gas 212. In some embodiments, a light gas purge stream 242 is removed from the upgraded treat gas stream 232 as needed.

In the illustrated embodiment, the first stage liquid effluent 228 comprising the first hydro-processed product is provided to a second separator 244 (e.g., distillation tower) to separate the first stage liquid effluent 228 into an overhead stream 246, a mid-cut stream 248, and a bottoms stream 250. The overhead stream 246 comprises, for example, from 1 wt. % to 20 wt. % of the first hydro-processed product. The mid-cut stream 248 comprises, for example, from 20 wt. % to 70 wt. % of the first hydro-processed product. The bottoms stream 250 comprises from 10 wt. % to 60 wt. % of the first hydro-processed product. In accordance with present embodiment, the mid-cut stream 248 is recycled as recycle fluid 204 to be used as the utility fluid in the first stage and/or carried away as a separate mid-cut product stream 252.

As illustrated, the bottoms stream 250 is pumped via pump 251 to a second stage where it is combined with a second stage treat gas stream 254, for example, from treat gas 212, and heated in a fourth heat exchanger 256 before being feed into a second hydro-processing reactor 258 comprising one or more hydro-processing catalyst. The catalyst employed in the first and second hydro-processing reactors 208, 258 may be the same or different. While FIG. 2 illustrates introducing the bottoms stream 250 comprising the at least a portion of the hydro-processed product and hydrogen in a combined stream, it should be understood that embodiments include separately introducing one or more of these components to the second hydro-processing reactor 258. For example, at least a portion of the second stage treat gas stream 254 can be introduced into the second hydro-processing reactor 258 for intercooling. The second hydro-processing reactor 258 can operated at any suitable hydro-processing conditions, as described above. In the second hydro-processing reactor 258, the at least a portion of the hydro-processed product is hydro-processed by contact with at least one hydro-processing catalyst in the presence of the hydrogen to form a second hydro-processed product.

A second stage hydro-processed effluent 259 comprising the second hydro-processed product is conducted from the second hydro-processing reactor 258 to a third separator 260 for separating vapor stream 262 (e.g., heteroatom vapor, vapor-phase cracked products, unused treat gas, etc.) and second stage liquid effluent 264 (e.g., second hydro-processed product) from the second stage hydro-processed effluent 259. In one embodiment, the third separator 260 is a flash drum. The vapor stream 262 is optionally cooled in fifth heat exchanger 266 and then optionally passed to further separation in a fourth separator 268 for separating a second stage vapor product stream 270 and an additional liquid product stream 271. The second stage vapor product stream 270 optionally may be conducted to the amine tower 230 and optionally, combined with the first stage vapor product 226.

The second stage liquid effluent 264 and the additional liquid product stream 271 is then provided to a fifth separator 272 (e.g., distillation tower), where a second stage product overhead stream 274 and a second stage liquid product stream 276 are separated. The second stage liquid product stream 276 comprises at least a portion of the second hydro-processed product. Advantageously, the second hydro-processed product has desirable characteristics, e.g., higher concentration of three ring and four ring reactive molecules and low sulfur, such that it can be coked to form needle coke with less fouling and higher needle coke production than coking of a hydrocarbon pyrolysis tar that has not been hydro-processed.

Figure 3:
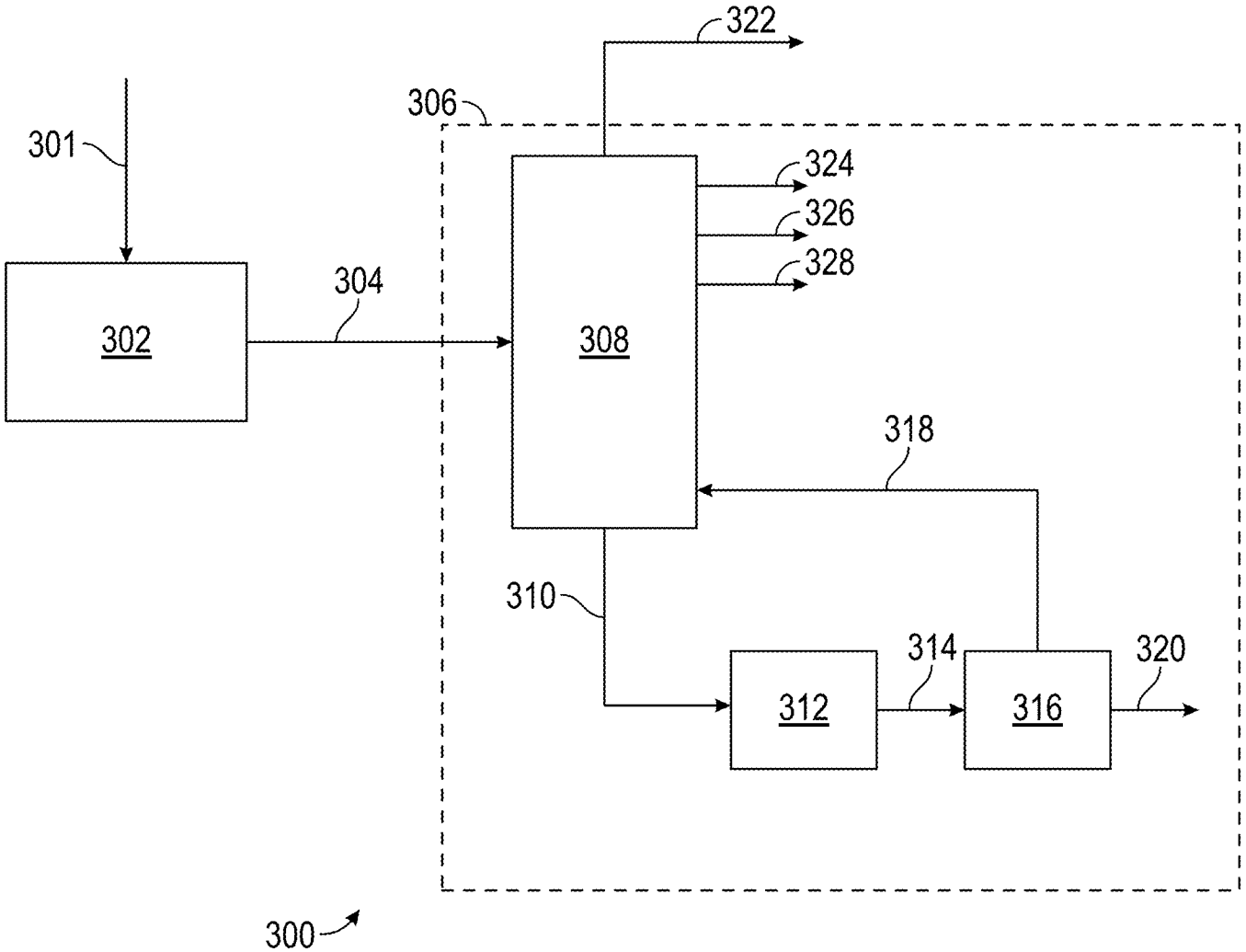
FIG. 3 is an example system that includes hydro-processing followed by delayed coking.

FIG. 3 illustrates an example system 300 for producing needle coke. In the illustrated embodiment, a tar feed 301 comprising a hydrocarbon pyrolysis tar (e.g., steam cracked tar) to be processed is fed into a hydro-processing stage 302. In the hydro-processing stage, the hydrocarbon pyrolysis tar is contacted with at least one hydro-processing catalysts in one or more hydro-processing stages to form a hydro-processed product. In at least one of the one or more hydro-processing stages, the hydrocarbon pyrolysis tar is contacted with the at least one hydro-processing catalysts in the presence of a utility fluid. A liquid product stream 304 comprising the hydro-processed product is then passed to delayed coking stage 306. In the delayed coking stage 306, the hydro-processed product, for example, is preheated and then coked. In some embodiments, preheating the hydro-processed product includes introducing the hydro-processed product to a coker fractionator 308 then withdrawing a fractionator effluent 310 comprising at least a portion of the hydro-processed product from the coker fractionator 308 to a coker furnace 312. From the coker furnace 312, the preheated effluent 314 comprising a preheated hydro-processed product is passed to a coking zone 316, which includes, for example, a coking vessel or coking drum. The preheated effluent 314 also includes tower bottoms (or recycle). The coking zone 316 is operated at coking conditions such that the preheated hydro-processed product thermally cracks over a period of time (the "coking time") in the coke zone, liberating volatiles composed primarily of hydrocarbon products that continuously rise through the coke bed, which consists of channels, pores and pathways, and are collected overhead as a coker effluent 318, which is passed to the coker fractionator 308. In the illustrated embodiment, the coker effluent 318 is separated in the coker fractionator 308 into various fractions, including, but not limited to, a coker gas fraction 322. a coker naphtha fraction 324, a coker distillate fraction 326, and a coker gas oil fraction 328.

As previously mentioned, coke is accumulated in the coking zone 316 (e.g., coking vessel). The coke includes needle coke. A coke product 320 comprising needle coke is withdrawn from the coking zone 316.

Additional Embodiments

Accordingly, the present disclosure provides for preparation of needle coke from hydrocarbon liquids. The methods and systems include any of the various features disclosed herein, including one or more of the following statements.

Embodiment 1. A method of needle coke production, comprising: hydro-processing a hydrocarbon liquid by contacting the hydrocarbon liquid with at least one hydro-processing catalyst in one or more hydro-processing stages to form a hydroprocessed product, wherein the hydro-processing of the hydrocarbon liquid in at least one of the one or more hydro-processing stages is performed in the presence of a utility fluid, wherein the hydrocarbon liquid comprises an initial boiling point at atmospheric pressure of about 200° C. or greater in accordance with ASTM 7500, wherein the hydrocarbon liquid comprises an aromatic content of about 50 wt. % or greater; and coking at least a portion of the hydroprocessed product to form a coker effluent and coke, wherein the coke comprises needle coke.

Embodiment 2. The method of Embodiment 1, wherein the hydrocarbon liquid comprises a hydrocarbon pyrolysis tar.

Embodiment 3. The method of Embodiment 1 or Embodiment 2, wherein the hydrocarbon liquid comprises a hydrocarbon pyrolysis tar having an initial boiling point of about 200° C. or greater, as determined in accordance with ASTM D7500, and wherein the hydrocarbon pyrolysis tar comprises aromatic compounds having ≥15 carbon atoms in an amount of about 50 wt. % or greater.

Embodiment 4. The method of any preceding Embodiment, wherein the hydrocarbon liquid comprises steam cracker tar.

Embodiment 5. The method of any preceding Embodiment, wherein the hydrocarbon liquid comprises sulfur in an amount of about 3 wt. % to about 4.5 wt. %, and wherein the needle coke comprises sulfur in an amount of about 0.5 wt. % or less.

Embodiment 6. The method of any preceding Embodiment, wherein the hydro-processed product has a sulfur content of about 0.5 wt. % or less.

Embodiment 7. The method of any preceding Embodiment, wherein the hydro-processed product comprises three-ring and four-ring aromatic compounds in a combined amount of about 70 wt. % or greater.

Embodiment 8. The method of any preceding Embodiment, wherein the hydro-processed product comprises an initial boiling point at atmospheric pressure of 200° C. to 400° C. and a final boing point at atmospheric pressure of 500° C. to 700° C., as determined in accordance with ASTM 7500, and wherein the hydro-processed product has a BMCI of about 90 to about 160.

Embodiment 9. The method of any preceding Embodiment, wherein the utility fluid comprises at least a portion of an interstage hydro-processed product that is recycled for combination with the hydrocarbon liquid.

Embodiment 10. The method of any preceding Embodiment, wherein the utility fluid has a solubility blending number of about 100 or greater.

Embodiment 11. The method of any preceding Embodiment, wherein the utility fluid comprises aromatic compounds in an amount of about 25 wt. % or greater.

Embodiment 12. The method of any preceding Embodiment, wherein the needle coke comprises sulfur in an amount of about 0.5 wt. % or less.

Embodiment 13. The method of any preceding Embodiment, wherein the needle coke comprises sulfur in an amount of about 0.1 wt. % or less.

Embodiment 14. The method of any preceding Embodiment, wherein the coke product comprises the needle coke in an amount of about 25 wt. % to about 60 wt. %.

Embodiment 15. The method of any preceding Embodiment, wherein the hydro-processing comprises: hydro-processing the hydrocarbon liquid in a first hydro-processing stage in the present of the utility fluid to produce a first stage hydro-processed effluent; separating at least a first stage hydro-processed product from the first stage hydro-processed effluent; and hydro-processing at least a portion of the first stage hydro-processed product in a second hydro-processing stage to product a second stage hydro-processed effluent; and separating at least a second stage hydro-processed product from the second stage hydro-processed effluent, wherein the second stage hydro-processed product comprises the hydro-processed product.

Embodiment 16. The method of any preceding Embodiment, wherein the coking at least a portion of the hydro-processed product comprises: feeding the hydro-processed product into a coker fractionator; heating at least a portion of a fractionator effluent from the coker fractionator in a coker furnace, wherein the fractionator effluent comprises at least a portion of the hydro-processed product; thermally cracking the fractionator effluent in a coking vessel to form at least a coker effluent and the coke product; and feeding the coker effluent to the coker fractionator for separation into two or more fractions.

Embodiment 17. A method of needle coke production, comprising: hydro-processing a feedstock comprising a steam cracker tar and a utility fluid in a first hydro-processing stage by contacting the feedstock with at least one first stage hydro-processing catalyst in the presence of molecular hydrogen to produce a first stage hydro-processed effluent, wherein the steam cracker tar has an initial boiling point of about 200° C. or greater, as determined in accordance with ASTM D7500, and wherein the steam cracker tar comprises 15 aromatic compounds having ≥15 carbon atoms in an amount of about 50 wt. % or greater; wherein the utility fluid has a solubility blending number of about 100 or greater and comprises aromatic compounds in an amount of about 25 wt. % or greater; separating at least a first stage hydro-processed product from the first stage hydro-processed effluent; hydro-processing at least a portion of the first stage hydro-processed product in a second hydro-processing stage by contacting the at least a portion of the first stage hydro-processed product with at least one second stage hydro-processing catalyst in the presence of additional molecular hydrogen to produce a second stage hydro-processed effluent; separating at least a second stage hydro-processed product from the second stage hydro-processed effluent; wherein the second stage hydro-processed product comprises a sulfur content of about 0.5 wt. % or less and has a BMCI of about 90 to about 160, wherein the second stage hydro-processed product comprises an initial boiling point at atmospheric pressure of 300° C. to 400° C. and a final boing point at atmospheric pressure of 500° C. to 600° C., as determined in accordance with ASTM 7500; and coking at least a portion of the second stage hydro-processed product to form at least a coker effluent and needle coke, wherein the needle coke comprises sulfur in an amount of 0.5 wt. % or less.

Embodiment 18. The method of Embodiment 17, wherein the separating at least the first stage hydro-processed product from the first stage hydro-processed effluent comprises separating the first stage hydro-processed effluent in one or more stages to form at least: (i) an overhead stream comprising ≥about 1 wt. % of the first hydro-processed product; (ii) a mid-cut stream comprising ≥about 20 wt. % of the first hydro-processed product and having a boiling point distribution from about 120° C. to about 480° C. as measured according to ASTM D7500; and (iii) a bottoms stream comprising ≥about 10 wt. % of the first hydro-processed product, wherein at least a portion of the bottoms stream is hydro-processed in the second hydro-processing stage.

Embodiment 19. The method of Embodiment 18, further comprising recycling at least a portion of the mid-cut stream for use as at least a portion of the utility fluid in the first hydro-processing stage.

Embodiment 20. The method of any one of Embodiments 17 to 19, wherein the coking comprises: feeding the hydro-processed product into a coker fractionator; heating at least a portion of a fractionator effluent from the coker fractionator in a coker furnace, wherein the fractionator effluent comprises at least a portion of the second stage hydro-processed product; thermally cracking the fractionator effluent in a coking vessel to form at least a coker effluent and the coke product; and feeding the coker effluent to the coker fractionator for separation into two or more fractions.

EXAMPLES

Example 1—Tar Hydroprocessing (SATC Process)

The following example was performed to illustrate upgrading a hydrocarbon pyrolysis tar to a hydro-processed product. In this example, steam cracker tar having density of 1.16 g/cm$^3$ was mixed with a solvent (utility fluid) having density 0.94 g/cm$^3$. The combined feed was directed to two-stage fixed bed reactors. The two-stage reactor was operated at 400° C. for first reactor stage, 370° C. for the second reactor stage, 1100 psi (7584 kpa) and a WHSV of 1.0 h$^{-1}$. Hydrogen to combined feed ratio for both experiments was provided at 3000 scfb.

The total liquid product from the second reactor was distilled to form a SATC product for analysis. Fractions boiling between 340° C. and 620° C. were combined and used for needle coke experiments in Example 2.

The properties of the hydro-processed steam cracker tar product both before and after hydro-processing are provided in the table below.

TABLE 1

| | Steam Cracker Tar Before Hydroprocessing | Hydro-processed Steam Cracker Tar |
|---|---|---|
| API Gravity 60° F. (15.5° C.) | Not determined | 3.1 |
| Density 60° F (g/mL) | 1.1508 | 1.0514 |
| Sulfur (wt. %) | 4 | 0.105 |

TABLE 1-continued

| | Steam Cracker Tar Before Hydroprocessing | Hydro-processed Steam Cracker Tar |
|---|---|---|
| Nitrogen (wt. %) | 0.2 | 0.04 |
| Carbon Residue by MCRT, >0.5% (wt. %) | 29.5 | 16.1 |
| Hydrocarbon Analysis | | |
| Saturates (wt. %) | Not determined | 0.6 |
| 1-Ring Aromatics (wt. %) | Not determined | 4.4 |
| 2-Ring Aromatics (wt. %) | Not determined | 14.6 |
| 3-Ring Aromatics (wt. %) | Not determined | 21.6 |
| 4-Ring Aromatics (wt. %) | Not determined | 49.1 |
| 4+-Ring Aromatics (wt. %) | Not determined | 9.8 |
| Hydrogen by NMR(wt. %) | Not Determined | 7.88 |
| Heptane Insolubles (wt. %) | 29.1 | — |

Example 2—Decant Oil Hydroprocessing

For comparative purposes, decant oil was hydro-processed (without a utility fluid) with the resultant hydro-processed decant oil used in the needle coke experiments of Example 3. The decant oil is a blend of low and high sulfur decant oil from at least 4 different refineries. The decant oil was hydro-processed using a sulfide NiMo catalyst at 390° C. in a reactor maintained at 2400 psia of hydrogen. The liquid hourly space velocity was maintained at 0.4 $h^{-1}$. The total liquid product was fractionated to remove the 350° C. minus component and the heavier fraction was used in the needle coke experiments.

The properties of the hydro-processed decant oil product before and after hydro-processing are provided in the table below.

TABLE 2

| | Decant Oil Before Hydroprocessing | Hydroprocessed Decant Oil |
|---|---|---|
| API Gravity 60° F. (15.5° C.) | −0.01 | 5.4 |
| Density (g/mL) | 1.0761 | 0.9997 |
| Sulfur (wt. %) | 3.1 | 0.481 |
| Nitrogen (ppm) | 0.25 | <0.1 |
| Carbon Residue by MCRT, >0.5% (wt. %) | 12.5 | 3.07 |
| Hydrocarbon Analysis | | |
| Saturates (wt. %) | 6.2 | 14 |
| 1-Ring Aromatics (wt. %) | 1.9 | 15.6 |
| 2-Ring Aromatics (wt. %) | 3.5 | 27.2 |
| 3-Ring Aromatics (wt. %) | 16.9 | 26.3 |
| 4-Ring Aromatics (wt. %) | 63.2 | 14.5 |
| Sulfides (wt. %) | 5.1 | 1.7 |
| Polars (wt. %) | 3.2 | 0.7 |
| Hydrogen by NMR (wt. %) | 7.26 | 8.18 |
| N-Heptane Insolubles (wt. %) | 0.7 | 0.11 |

Example 3—Needle Coke Production

Figure 4:
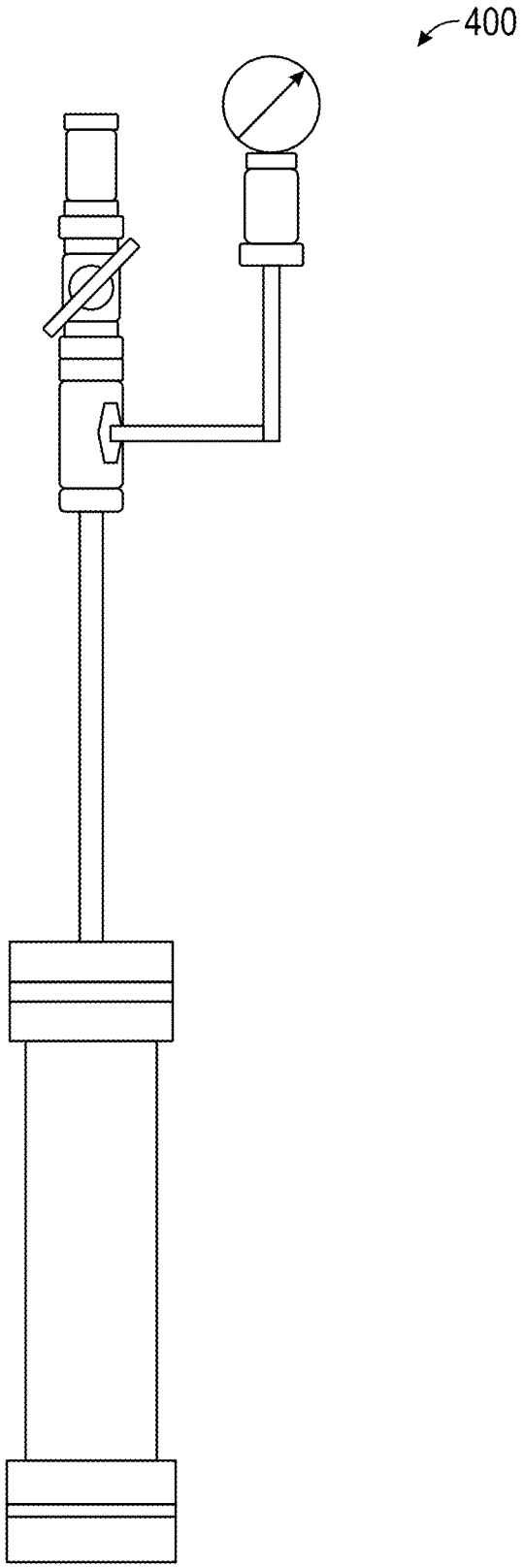
FIG. 4 is an example of a laboratory scale batch coker reactor used in the production of needle coke for the examples disclosed herein.

The following examples were performed to illustrate production of needle coke from hydrocarbon liquids, such as hydrocarbon pyrolysis tars. Approximately 3-4 grams of the hydro-processed steam cracker tar product from Example 1 was fed to a laboratory scale batch coker reactor at maintained at delayed condition conditions of 500° C. for 5 hours with auto thermal pressure. The laboratory scale batch coker reactor is shown on FIG. 4 at reference number 400. The reactor was filled with aluminum foil tubes for easy recovery of semi-coke products. At the end of each run, the reactor was air/water cooled to room temperature and depressurized after sampling of the head space gas. After opening the reactor, dichloromethane was used to wash the semi-coke and the inside of the reactor to recover liquid products. Recovered semi-cokes were weighed after evaporation of the dichloromethane. Two runs were performed with the hydro-processed steam cracker tar product. For comparative purposes, a conventional delayed coker feed was also tested. The conventional delayed coker feed was the hydro-processed decant oil product from Example 2.

The yields from each run of the hydro-processed steam cracker tar and hydro-processed decant oil products are shown in Table 3 below.

TABLE 3

| Sample | Run | Coke Wt (g) | Coke Yield (%) | Liquid Yield (%) | Gas Yield (%) |
|---|---|---|---|---|---|
| Hydro-processed Steam Cracker Tar Product | 1 | 1.7 | 39 | 48 | 14 |
| Hydro-processed Steam Cracker Tar Product | 2 | 1.08 | 24 | 67 | 9 |
| Hydro-processed Decant Oil Product (comparative) | 1 | 3.4 | 52 | 40 | 7 |
| Hydro-processed Decant Oil Product (comparative) | 2 | 1.05 | 49 | 45 | 6 |

Both the hydro-processed steam cracker and hydro-processed decant oil products produced coherent coke cylinders upon carbonization. Even further, optical images of the coke obtained from both samples showed needle-like structures, indicating the production of needle coke. The needle coke for the hydro-processed steam cracker product was low sulfur as the hydro-processed steam cracker tar product had a sulfur content of 0.105 wt. %.

While compositions, methods, and processes are described herein in terms of "comprising," "containing," "having," or "including" various components or steps, the compositions and methods can also "consist essentially of" or "consist of" the various components and steps. The phrases, unless otherwise specified, "consists essentially of" and "consisting essentially of" do not exclude the presence of other steps, elements, or materials, whether or not, specifically mentioned in this specification, so long as such steps, elements, or materials, do not affect the basic and novel characteristics of the disclosure, additionally, they do not exclude impurities and variances normally associated with the elements and materials used.

All numerical values within the detailed description are modified by "about" the indicated value, and take into account experimental error and variations that would be expected by a person having ordinary skill in the art.

Many alterations, modifications, and variations will be apparent to those skilled in the art in light of the foregoing description without departing from the spirit or scope of the present disclosure and that when numerical lower limits and numerical upper limits are listed herein, ranges from any lower limit to any upper limit are contemplated.

What is claimed is:

1. A method of needle coke production, comprising:

hydro-processing a hydrocarbon liquid by contacting the hydrocarbon liquid with at least one hydro-processing catalyst in one or more hydro-processing stages to form a hydroprocessed product, wherein the hydro-processing of the hydrocarbon liquid in at least one of the one or more hydro-processing stages is performed in the presence of a utility fluid, wherein the hydro-processed product comprises three-ring and four-ring aromatic compounds in a combined amount of about 70 wt. % or greater, wherein the hydrocarbon liquid comprises an initial boiling point at atmospheric pressure of about 200° C. or greater in accordance with ASTM 7500;

wherein the hydrocarbon liquid comprises an aromatic content of about 50 wt. % or greater; and coking at least a portion of the hydro-processed product to form a coker effluent and coke, wherein the coke comprises needle coke.

2. The method of claim 1, wherein the hydrocarbon liquid comprises a hydrocarbon pyrolysis tar.

3. The method of claim 1, wherein the hydrocarbon liquid comprises a hydrocarbon pyrolysis tar having an initial boiling point of about 200° C. or greater, as determined in accordance with ASTM D7500, and wherein the hydrocarbon pyrolysis tar comprises aromatic compounds having ≥15 carbon atoms in an amount of about 50 wt. % or greater.

4. The method claim 1, wherein the hydrocarbon liquid comprises steam cracker tar.

5. The method of claim 1, wherein the hydrocarbon liquid comprises sulfur in an amount of about 3 wt. % to about 4.5 wt. %, and wherein the needle coke comprises sulfur in an amount of about 0.5 wt. % or less.

6. The method of claim 1, wherein the hydro-processed product has a sulfur content of about 0.5 wt. % or less.

7. The method of claim 1, wherein the hydro-processed product comprises an initial boiling point at atmospheric pressure of 200° C. to 400° C. and a final boing point at atmospheric pressure of 500° C. to 700° C., as determined in accordance with ASTM 7500, and wherein the hydro-processed product has a BMCI of about 90 to about 160.

8. The method of claim 1, wherein the utility fluid comprises at least a portion of an interstage hydro-processed product that is recycled for combination with the hydrocarbon liquid.

9. The method of claim 1, wherein the utility fluid has a solubility blending number of about 100 or greater, and wherein the utility fluid comprises aromatic compounds in an amount of about 25 wt. % or greater.

10. The method of claim 1, wherein the needle coke comprises sulfur in an amount of about 0.5 wt. % or less.

11. The method of claim 1, wherein the needle coke comprises sulfur in an amount of about 0.1 wt. % or less.

12. The method of claim 1, wherein the hydro-processing comprises:

hydro-processing the hydrocarbon liquid in a first hydro-processing stage in the present of the utility fluid to produce a first stage hydro-processed effluent;

separating at least a first stage hydro-processed product from the first stage hydro-processed effluent; and hydro-processing at least a portion of the first stage hydro-processed product in a second hydro-processing stage to product a second stage hydro-processed effluent; and separating at least a second stage hydro-processed product from the second stage hydro-processed effluent, wherein the second stage hydro-processed product comprises the hydro-processed product.

13. The method of claim 1, wherein the coking at least a portion of the hydro-processed product comprises:

feeding the hydro-processed product into a coker fractionator;

heating at least a portion of a fractionator effluent from the coker fractionator in a coker furnace, wherein the fractionator effluent comprises at least a portion of the hydro-processed product;

thermally cracking the fractionator effluent in a coking vessel to form at least a coker effluent and the coke product; and feeding the coker effluent to the coker fractionator for separation into two or more fractions.

14. A method of needle coke production, comprising:

hydro-processing a hydrocarbon liquid by contacting the hydrocarbon liquid with at least one hydro-processing catalyst in one or more hydro-processing stages to form a hydroprocessed product, wherein the hydro-processing of the hydrocarbon liquid in at least one of the one or more hydro-processing stages is performed in the presence of a utility fluid, wherein the hydrocarbon liquid comprises an initial boiling point at atmospheric pressure of about 200° C. or greater in accordance with ASTM 7500;

wherein the hydrocarbon liquid comprises an aromatic content of about 50 wt. % or greater; and coking at least a portion of the hydro-processed product to form a coker effluent and coke, wherein the coke comprises needle coke in an amount of about 25 wt. % to about 60 wt. %.

15. The method of claim 1, wherein the hydrocarbon liquid comprises a hydrocarbon pyrolysis tar.

16. The method of claim 1, wherein the hydrocarbon liquid comprises a hydrocarbon pyrolysis tar having an initial boiling point of about 200° C. or greater, as determined in accordance with ASTM D7500, and wherein the hydrocarbon pyrolysis tar comprises aromatic compounds having ≥15 carbon atoms in an amount of about 50 wt. % or greater.

17. The method claim 1, wherein the hydrocarbon liquid comprises steam cracker tar.

18. The method of claim 1, wherein the utility fluid comprises at least a portion of an interstage hydro-processed product that is recycled for combination with the hydrocarbon liquid.

* * * * *